United States Patent [19]

Wilson et al.

[11] 4,174,875

[45] Nov. 20, 1979

[54] COAXIAL WET CONNECTOR WITH SPRING OPERATED PISTON

[75] Inventors: Jeffrey V. Wilson, Camarillo; James H. Schaefer, Del Mar; Anthony A. Glowacz, Northridge; Jack Bayha, Canoga Park, all of Calif.

[73] Assignee: The United States of America as represented by the Secretary of the Navy, Washington, D.C.

[21] Appl. No.: 910,249

[22] Filed: May 30, 1978

[51] Int. Cl.[2] ..... H01R 17/06

[52] U.S. Cl. ..... 339/91 P; 339/117 P; 339/177 E

[58] Field of Search ..... 339/94 C, 117 R, 117 P, 339/177 E, 177 R, 91 P

[56] References Cited

U.S. PATENT DOCUMENTS 4,039,242 8/1977 Wilson et al. ..... 339/117 P

*Primary Examiner*—Neil Abrams

*Attorney, Agent, or Firm*—Richard S. Sciascia; J. M. St. Amand; Darrell E. Hollis

[57] ABSTRACT

A coaxial wet connector for connecting coaxail conductors of electromechanical ocean cables underwater either by a diver or submersible manipulator. The connector comprises a male section having a male inner conductor extending outwards from a concentric male outer conductor and a female section containing a spring biased shuttle piston for receiving the male inner conductor upon mating. An O-ring wiping seal wipes the male inner conductor clean of water as the male inner conductor drives the shuttle piston rearward within a female housing until electrical interconnection between the male and female sections is completed. A pressure compensating bladder removes water trapped adjacent an interconnection surface during mating and returns the water to the interconnection surface during decoupling thereby preventing a hydraulic lock between the male and female sections. A plurality of latch members pivotably connected to the male section and operable to engage a ridge on the feamle section is provided for transferring the mechanical forces from the female outer conductor to the female housing to the male housing and back to the male outer conductor.

56 Claims, 6 Drawing Figures

COAXIAL WET CONNECTOR WITH SPRING OPERATED PISTON

BACKGROUND OF THE INVENTION

1. Field of the Invention

This invention relates generally to underwater cable connectors and more particularly to coaxial connectors for underwater connection.

2. Description of the Prior Art

One prior art coaxial wet connector for connecting coaxial conductors of electromechanical ocean cables underwater includes a male section having a male inner conductor extending outward from a concentric male outer conductor and a female section having a shuttle piston for receiving the male inner conductor. An O-ring wiping seal is provided to wipe the male inner conductor clean of water as the male inner conductor drives the shuttle piston rearward within the female housing until electrical interconnection between the male and female sections is completed. A female facing lip is disposed within the female housing to mate with a male facing disposed within the male housing such that water caught in the area adjacent the shuttle piston and the male and female facings is ejected by peristalic action. The space between the back side of the shuttle piston and the female inner conductor is oil filled and in fluidic communication with a circumferential bladder as are a plurality of hydraulic actuated latches utilized to transfer the mechanical forces from the female outer conductor to the female housing to the male housing and back to the male outer conductor. A squeeze ring surrounds the circumferential bladder and when a squeezing force is applied thereto a hydraulic force is applied to the back side of the shuttle piston such that the shuttle piston is driven to its forward position thereby disconnecting the male and female sections. At the same time the hydraulic force actuates the latch members to allow disengagement of the female section from the male section.

It has been found that the use of internal hydraulics powered by a squeeze ring and bladder to move the shuttle piston and simultaneously operate the latch members is complicated, difficult to build, expensive, requires higher mating forces and unmating forces than can be easily handled by divers using manipulators and, in addition, produced a larger, longer connector when mated than desired. Also, the hydraulic system prevents the shuttle piston from moving quickly enough when the connectors are unmated under tension. In addition, it was found that the female facing lip and the male facing that ejected water by peristalic action worked well during mating, allowing trapped seawater to be expelled easily. However, the seal created during mating remained effective during decoupling producing a hydraulic lock in the space between the inner conductor wiping seal and the male and female facing lips. At high ambient pressures, this increased the unmating force beyond the working limits of divers or submersible manipulator systems.

SUMMARY OF THE INVENTION

In order to overcome the above enumerated disadvantages among others, the present invention provides a coaxial wet connector having a male section and a female section for electrically and mechanically connecting a coaxial cable. The present invention produces a nearly perfect impedance match while maintaining the coaxial mode of signal propagation. Also, it is depth independent since it is oil filled and has excellent long term reliability since it is pressure balanced and utilizes liquid dielectrics which hold up well under high voltages. The connector of the present invention comprises a male section having a male inner conductor extending outwards from a concentric male outer conductor and a female section having a spring biased shuttle piston for receiving the male inner conductor. An O-ring wiping seal wipes the male inner conductor clean of water as the male inner conductor drives the shuttle piston rearward within the female housing until electrical interconnection between the male and female sections is completed. A female facing lip disposed within the female housing engages a male facing disposed within the male housing such that a water-tight seal is formed therebetween. A pressure compensating bladder disposed within the male housing is in fluidic communication with the area adjacent an interconnection surface located between the facing lip seal and the wiping seal such that water trapped therein is removed therefrom during mating and returned thereto upon decoupling thereby preventing the formation of a hydraulic lock during mating and decoupling. A slidable collar circumferentially disposed about the male housing, operably engages a plurality of latch members pivotally connected to the male housing. The latch members engage the female housing about a latch ridge during mating. Thus, the internal hydraulic circuits of the prior art requiring a squeeze force for mating and unmating have been eliminated, thereby making the present invention compatible with a wider variety of underwater vehicle manipulator systems and much easier to operate manually be divers.

Accordingly, one object of the present invention is to provide an underwater wet connector.

Another object of the present invention is to provide an oil filled pressure compensated coaxial wet connector.

A still further object of the present invention is to provide a nearly perfect impedance match.

Another object of the present invention is to provide for operation at high voltage levels.

A still further object of the present invention is to provide an improved capability to connect coaxial cables underwater while maintaining electrical and mechanical integrity in the presence of high voltage.

Another object of the present invention is to provide an underwater connector wherein the male and female sections are rotatable with respect to each other.

A further object of the present invention is to simplify the operation of the connector and reduce the complexity of fabrication and maintenance.

Other objects and a more complete appreciation of the present invention and its many attendant advantages will develop as the same becomes better understood by reference to the following detailed description when considered in connection with the accompanying drawings in which like reference numerals designate like parts throughout the figures thereof and wherein.

DETAILED DESCRIPTION OF THE PREFERRED EMBODIMENT

The present invention is utilized to interconnect the electrical and mechanical members of coaxial ocean cables while under water. The connections may be made by a diver or remote manipulator. The connection may be broken at any time without flooding the cable with seawater and may be remated underwater without loss of mechanical or electrical performance. The connectors are designed to carry the full breaking strength of the cable and to transmit electrical signals at high frequencies and at high voltages without excessive cornoa noise or impedance mismatch. The connectors are independent of operating depth being oil filled and pressure compensated. The present invention provides for coaxial configuration of the signal leads through the connector, has no rotational phase to phase keying requirement and may be easily decoupled through manual manipulation by a diver.

Figure 1:
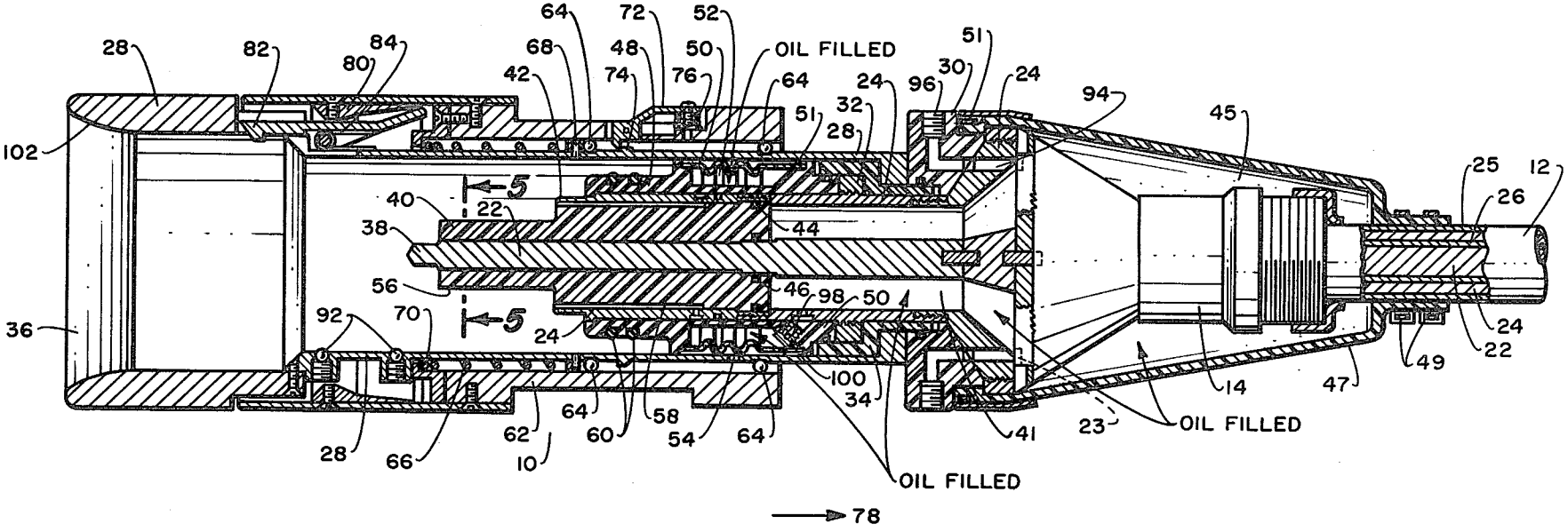
FIG. 1 is a partial cross sectional view of a male section of one embodiment of the present invention.
Figure 2:
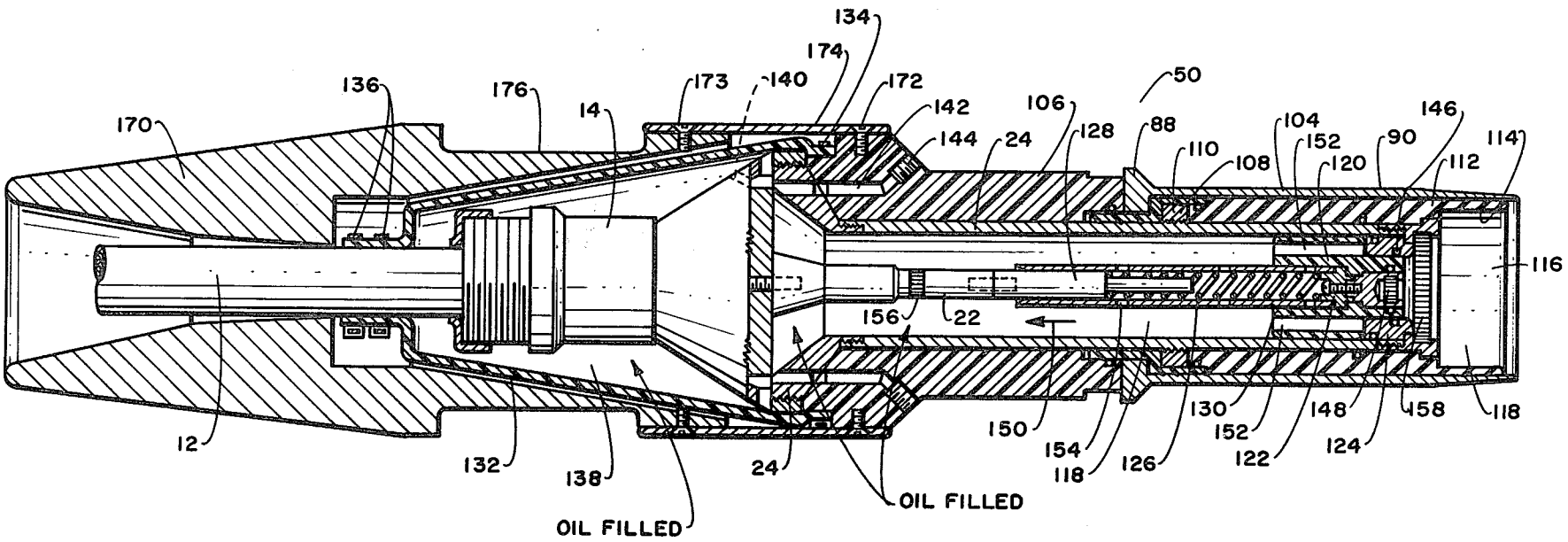
FIG. 2 is a partial cross sectional view of a female section of one embodiment of the present invention.

The connector includes two halves, a female section 50 illustrated in FIG. 2 and a male section 10 illustrated in FIG. 1. All of the electrical moving parts and most of the primary mating functions are performed within female section 50. Both female section 50 and male section 10 are attached to a coaxial cable 12 by means of a modification 14 of a standard molded termination assembly developed by Bell Telephone for use with S.D. communication cables.

Cable 12 contains a coaxial conductor configuration with a strength dielectric material 26 such as polyethylene concentrically sandwiched between inner conductor 22 and outer conductor 24. Outer conductor 24 is covered with a protective layer 25.

A detailed description of the connection of coaxial cable 12 to the female section 50 and male section 10 by means of modification 14 is given in U.S. Pat. No. 4,039,242 entitled COAXIAL WET CONNECTOR by Jeffrey V. Wilson and Ronald L. Brackett. Specifically, the reader's attention is directed to FIG. 1 of U.S. Pat. No. 4,039,242.

Now returning to FIG. 1, the mechanical forces exerted on outer conductor 24 by cable 12 are transferred to male housing 28 by cone ring 30, shell ring 32 and spacer ring 34. Shell ring 32 is rigidly affixed to outer conductor 24 via screw threads. Cone ring 30 and spacer ring 34 are fabricated from a rigid dielectric material so as to electrically isolate housing 28 from male outer conductor 24.

Space 41 is oil filled and pressure compensated via orifice 23 which fluidically interconnects space 41 with space 45 formed between boot 47 and modification 14. Space 45 is also oil filled. Boot 47, fabricated from a corrosion resistant flexible material such as neoprene or butyl transmits the ambient pressure to the oil filled spaces 41 and 45. Boot clamps 49 and 51 provide a water-tight seal between boot 47 and cable 12 at one end and between boot 47 and cone ring 30 at the other end. Spaces 41 and 45 are filled with oil via orifice 94 through fill and vent valve 96 disposed therein.

Inner conductor 22 extends outwards from modification 14 within male housing 28 to a point adjacent central opening 36 of male housing 28. Inner conductor 22 is provided with termination end 38.

Outer conductor 24 extends outwards from modification 14 to a point recessed further from central opening 36 than termination end 38 of inner conductor 22. Male core dielectric insert 40 provides physical separation for support as well as electrical isolation between outer conductor 24 and inner conductor 22. Male core insert 40 is fabricated from a rigid dielectric material having mechanical strength. Male core insert 40 extends outward to a point adjacent termination end 38 of inner conductor 22. O-ring seals 44 and 46 prevent oil from space 41 from leaking out between male core insert 40 and outer conductor 24 and inner conductor 22.

Pressure compensating bladder 52 is formed within male facing 48 by fluid tightly attaching boot 50 to male facing 48 by use of screw clamps 51. Circumferential bladder 52 is exposed to the ambient environment via orifice 54 and is in fluidic communication with the area adjacent interconnection surface 56 via annular space 58. Boot 50 is fabricated from a corrosion resistant flexible material such as neoprene or butyl.

Figure 3:
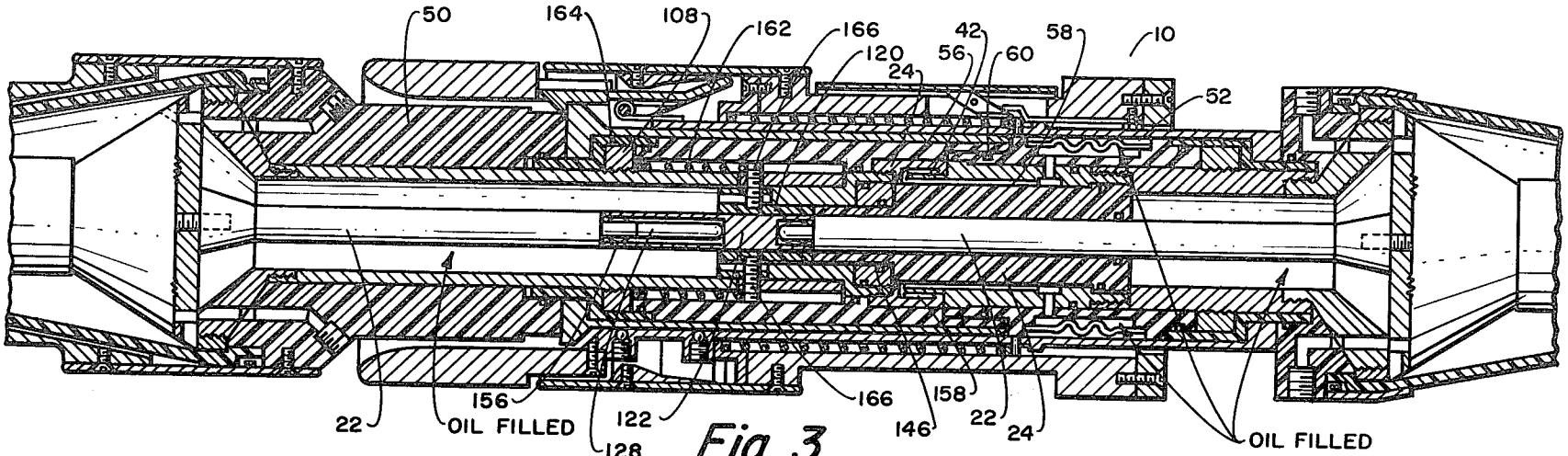
FIG. 3 is a partial cross sectional view of the male and female sections illustrated in FIGS. 1 and 2 with modifications after mating.

During mating, circumferential bladder 52 allows water trapped adjacent interconnection surface 56, i.e., the surface located between wiping seal 146 and O-ring 60 in FIG. 3, to be drawn into annular space 58 and to be returned to the space adjacent interconnection surface 56 during decoupling of male section 10 from female section 50. Thus, pressure compensating circumferential bladder 52 eliminates any hydraulic lock that might otherwise form if the trapped water adjacent interconnection surface 56 were not provided with pressure compensation.

Pressure compensating bladder 52 fluidically communicates with space 41 via orifice 98 which contains a pressure relief valve 100. During mating should the pressure of the water entering annular space 58 produce an excessive pressure within bladder 52, pressure relief valve 100 will open thereby relieving the pressure within pressure compensating bladder 52.

A pair of O-rings 60 are disposed within circumferential grooves in male facing 48 for providing a water-tight seal between male facing 48 and female facing lip 112 after mating of male section 10 and female section 50.

Slidable collar 62 is circumferentially disposed about housing 28 with ball bearings 64 sandwiched between housing 28 and collar 62 to facilitate the movement of collar 62 with respect to housing 28. Slidable collar 62 is biased in the forward position as shown in FIG. 1 by spring 66 which abuts stop 68 (rigidly affixed to housing 28) at one end and to stop surface 70 of slidable collar 62 at the other end.

In its forward position as shown in FIG. 1 detent 72 is biased via spring 76 to engage ridge 74 thereby preventing slidable collar 62 from moving backward in the direction of arrow 78 with respect to housing 28 until detent 72 is squeezed by manipulator or diver. Latch ridge 80 of collar 62 is disposed with respect to latch members 82 such that when collar 62 is moved in the direction of arrow 78 latch ridge 80 will engage latch member 82 causing latch member 82 to pivot about pin 86 thereby moving latch member 82 from a latched position to an unlatched position. The pin 86 is rigidly affixed to housing 28 thereby allowing latch member 82 to hold the full breaking strength of coaxial cable 12. Latch member 82 is spring biased by spring 84 in the latching position such that during mating, latch member 82 engages female shell ridge 88 automatically as latch member 82 passes over female shell ridge 88. It is noted that in the embodiment of FIG. 1 there are three latch members 82 but only one is illustrated in the cross sectional view.

During mating, ball bearings 92 disposed within housing 28 of male section 10 engage surface 90 of female section 50 (FIG. 2) to facilitate mating therebetween.

Male housing 28 includes flared section 102 to facilitate proper alignment of male section 10 with female section 50.

Now turning to FIG. 2, female section 50 is illustrated in cross section except for modification 14. Female section 50 is connected to cable 12 via termination assembly 14 in the same manner as male section 10 is connected thereto.

The mechanical forces exerted on outer conductor 24 by cable 12 are transferred to female housing 104 by cone ring 106, shell ring 108 and spacer ring 110. Shell ring 108 is rigidly affixed to outer conductor 24 via screw threads. Spacer ring 110 and cone ring 106 are fabricated from a strength dielectric material so as to electrically isolate outer conductor 24 from female housing 104. In addition, female facing lip 112 is fabricated from a dielectric material in order to electrically isolate female housing 104 from outer conductor 24.

Upon mating, surface 114 of female facing lip 112 engages O-rings 60 of male facing 48 (FIG. 1) thereby creating a water-tight seal therebetween.

Outer conductor 24 extends outwards from inner conductor 22 to a point adjacent central opening 116 such that an interconnection space 118 is formed. Shuttle piston 120, disposed within interconnection space 118, rides between outer conductor 24 and inner conductor 22. Shuttle piston 120 includes an electrically conducting center conductor 122 for electrically interconnecting inner conductor 22 of female section 50 with inner conductor 22 of male section 10. The remainder of shuttle piston 120 is fabricated from an electrically insulating strength dielectric material.

Shuttle piston 120 is biased in a forward position against bulkhead 124 in the position shown in FIG. 2 by spring 126. Spring 126 engages shuttle piston 120 at one end thereof and engages termination projection 128 at the other end thereof. Termination projection 128 is fabricated from a strength dielectric material so that center conductor 122 of shuttle piston 120 is electrically isolated from inner conductor 22 when female section 50 is decoupled from male section 10 thereby allowing the connector to be operated with a voltage on female section 50.

Interconnection space 118 to the rear of the back side 130 is oil filled and pressure compensated by boot 132 which is water tightly connected to cone ring 106 at one end and cable 12 at the other end via screw clamps 134 and 136. Boot 132 is fabricated from a corrosion resistant flexible material such as neoprene or butyl. Oil filled space 138 fluidically communicates with interconnection space 118 via orifice 140. Oil is interjected into oil filled space 138 and interconnection space 118 via orifice 142 which includes vent and fill valve 144 contained therein.

Oil is prevented from leaking out of interconnection space 118 by O-ring wiping seal 147 which is disposed between bulkhead 124 and shuttle piston 120.

Termination end 38 of male inner conductor 22 engages center conductor 122 of shuttle piston 120 about Multilam or other suitable electrical contact band 148 thereby moving shuttle piston 120 rearward in the direction of arrow 150. As shuttle piston 120 moves rearward interconnection surface 56 of core dielectric 40 engages O-ring wiping seal 146 thereby preventing the oil, freely moving through shuttle piston 120 via orifices 152, from leaking out into interconnection space 118 adjacent central opening 116. When mated, the hollow extension 154 of center conductor 122 engages inner conductor 22 about Multilam contact 156 thereby completing the electrical interconnection between inner conductor 22 of female section 50 and inner conductor 22 of male section 10.

Outer conductor 24 of male section 10 engages outer conductor 24 of female section 50 about Multilam or other suitable electrical contact band 158 thereby providing electrical interconnection of outer conductor 24 between male section 10 and female section 50.

It is noted that Multilam contacts 158 and 148 provide electrical interconnection and allow the inner and outer conductors disposed in the male and female sections to rotate with respect to each other.

Figure 5:
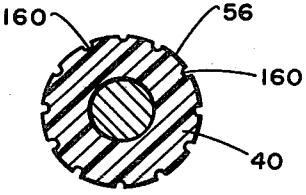
FIG. 5 is a cross section view of the male inner conductor taken along lines 5—5 of FIG. 1.

As can be seen from FIG. 3, once interconnection surface 56 of core dielectric 40 engages O-ring wiping seal 146 and O-ring seals 60 engages surface 114 of female facing lip 112 a small amount of seawater is trapped within interconnection space 118 adjacent interconnection surface 56. As shown in FIG. 5, core dielectric 40 contains small grooves 160 which allow venting of this trapped water into annular space 58 which communicates with pressure compensating bladder 52. Thus, the trapped water upon mating enters orifice 58 and upon decoupling exits orifice 58 thereby preventing a hydraulic lock from occurring between male section 10 and female section 50.

In summary, the mating operation precedes as follows. Male section 10 and the female section 50 are picked up by manipulators or divers and approximately aligned with respect to the longitudinal axis therethrough. As female section 50 is inserted into male section 50 adjacent guide section 102, the sections are accurately centered to become coaxial. Termination end 38 engages Multilam contact 148 contained within female shuttle piston 120 and begins to push shuttle piston 120 rearward within interconnection space 118. Wiping O-ring 146 disposed within grooves in bulkhead 124 wipes the surface 56 of strength dielectric core 40 clean of water thereby providing the primary wet mating action to establish a dielectric interface between inner conductor 22 and outer conductor 24 of the coaxial connector. As surface 114 of female facing lip 112 engages O-rings 60, trapped water is forced into pressure compensating bladder 52 expanding the same. Finally latch members 82 ride over female shell ridge 88 and snap down into engagement therewith locking female section 50 and male section 10 together laterally but allowing them rotational freedom therebetween. Prior to latching, the electrical contacts are established outer conductor to outer conductor and inner conductor to inner conductor as shown in FIG. 3.

To disengage male section 10 from female section 50, detent 72 is released from engagement with ridge 74 thereby allowing collar 62 to be forced to move in a direction of arrow 78. As collar 62 moves in the direction of arrow 78, latch ridge 80 engages latch member 82 causing latch member 82 to pivot about pin 86 thereby moving latch member 82 into its unlatched position. Once latch members 82 disengage shell ridge 88, the connectors may be decoupled with the trapped water returning to the space adjacent interconnection surface 56 from annular space 58. Spring 126 forces shuttle piston 120 forward until stopped by retaining bulkhead 124, thereby rendering fluid filled interconnection space 118 rearward to shuttle piston 120 watertight and electrically disconnecting center connector 120 from inner conductor 22 within female section 50. Once collar 62 is released, spring 66 forces it forward thereby returning latch members 82 to the latched position. Remating of male section 10 and female section 50 is now free to proceed.

Figure 4:
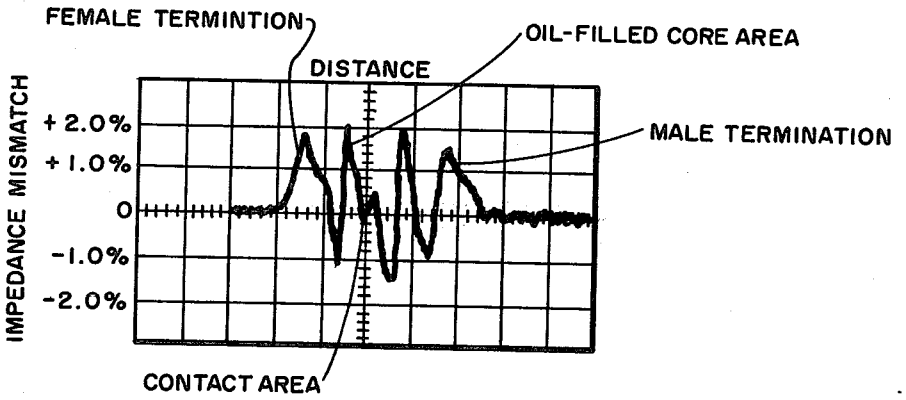
FIG. 4 graphically illustrates the impedance mismatch of the wet connector.

FIG. 4 illustrates the impedance mismatch traversing through male section 10 and female section 50 from female termination assembly 14 to male termination assembly 14.

It is noted that the oil filled sections may be filled with any suitable dielectric oil such as mineral oil or castor oil. In addition, the high strength electrically insulating dielectric material may be fabricated from any suitable materials such as plastics or polyvinylchloride. It is noted that all dielectric electrically insulating materials utilized within female section 50 and male section 10 have dielectric constants as closely matched to the dielectric constant of cable 12 as possible. Male housing 28 and female housing 104 are fabricated from a corrosion resistant high strength material.

Now turning to FIG. 3, male section 10 and female section 50 are illustrated after mating. Shuttle piston 120 has been driven rearward into interconnection space 118 to engage inner conductor 22 of male section 10 thereby electrically interconnecting inner conductors 22 of male section 10 and female section 50. The outer conductors 24 of male section 10 and female section 50 are mated with termination projection 42 engaging Multilam contact 158.

The seawater trapped adjacent interconnection surface 56 between Multilam contact 158 and O-ring seal 60 flows through Multilam contact 158 into annular space 58. That portion of the seawater trapped along the remainder of interconnection surface 56 travels along grooves 160 to enter annular space 58.

In the embodiment illustrated in FIG. 3, a spring 162 provides forward biasing to shuttle piston 120. As illustrated in FIG. 3, spring 162 engages stop surface 164 of shell ring 108 at one end thereof and engages stop pins 166 at the other end thereof. Stop pins 166 are screw threaded to shuttle piston 120 and are disposed to ride within slots 168 in outer conductor 24.

As shown in FIG. 3, shuttle piston 22 is disposed in its rearward position wherein electrical interconnection between inner conductors 22 has been effected whereas in FIG. 2, shuttle piston 120 is in its forward position abutting bulkhead 124.

The termination of the cable should be suited to the particular cable being used. For example, if multiple leads are involved other single pin connections may be distributed around the central coaxial lead. A plurality of shuttle pistons may be utilized one for each lead.

There is room for considerable variations in the selection of material utilized in the fabrication of various components of the present invention. The conductors should be fabricated from materials of such conductivity that they match the materials in the cable at the frequencies of interest. The strength dielectric materials within the male and female housings should approximate the dielectric constant of the cable dielectric as nearly as possible as should the fluid dielectrics utilized.

O-ring seals are appropriately disposed within the wet connector to prevent oil leakage. All such O-ring seals are not shown in the drawing.

The elastomers utilized for fabricating male facing 48 and female facing lip 112 are variable. A variety of resilient synthetic rubbers will suffice.

Now returning to FIG. 2, female section 50 is also provided with a gripping member 170 circumferentially disposed about female section 50 and attached thereto by screws 172 and 173 and attaching ring 174. Gripping member 170 is provided with groove 176 for permitting a tool or gripper utilized in existing submersible manipulators, a surface to grasp female section 50.

Figure 6:
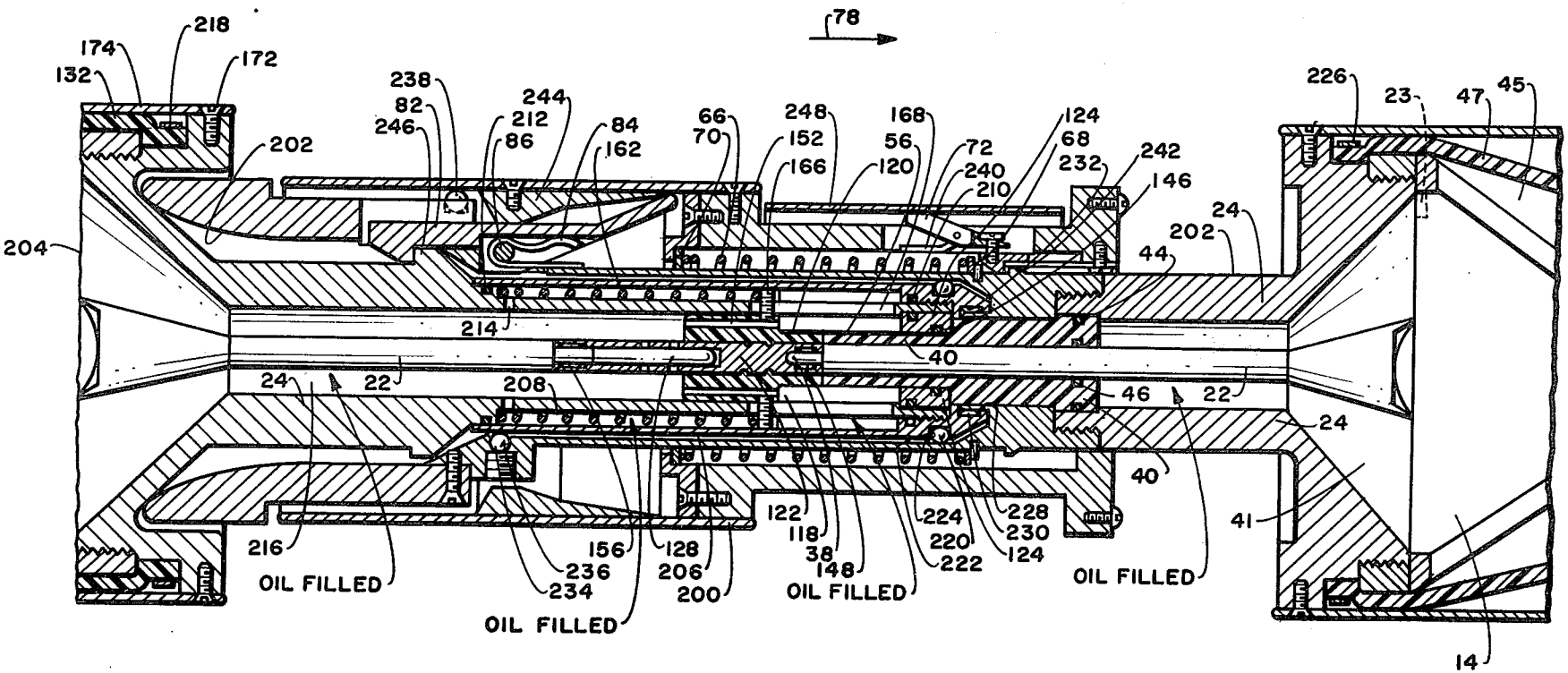
FIG. 6 is a partial cross-sectional view of a male and female section of one embodiment of the present invention after mating.

Now turning to FIG. 6 an alternative embodiment 200 is illustrated in partial cross section. Embodiment 200 includes a male section 202 and a female section 204.

Female section 204 includes a spring biased shuttle piston 120 having a spring 162 biasing it in abutting relationship with bulkhead 124. Spring 162 engages outer connector 24 at one end thereof and stop pins 166 at the other end thereof. Stop pins 166 are screw threaded to shuttle piston 12 and are disposed to ride within slots 168 in outer conductor 24.

As shown in FIG. 6 termination end 38 of male inner conductor 22 has driven shuttle piston 120 rearward within interconnection space 118 wherein electrical interconnection between male and female inner conductors 22 has been effected.

Spring cover ring 206 creates a oil filled annular space 208 in which spring 162 is disposed. A pair of O-rings 210 and 212 prevent oil leakage between spring cover ring 206 and outer conductor 24 of female section 204. Openings 214 link oil filled annular space 208 with oil filled space 216. Oil filled space 216 is in fluidic communication with an oil filled space (not shown) created by boot 132 which provides pressure compensation to oil filled space 216 and interconnection space 118 via orifices 152 in shuttle piston 120. The termination of female section 204 with cable 12 (not shown) is identical to the termination of female section 50 of FIG. 2 to cable 12 except that outer conductor 24 of female section 204 is exposed to the ambient or seawater environment. Thus, boot 132 is fluid tightly connected to outer conductor 24 of female section 204 in FIG. 6 by screw clamp 218 while boot 132 is fluid tightly connected to electrically inulsating cone ring 106 of female section 50 of FIG. 2.

Also as in FIG. 2, female section 204 of FIG. 6 includes a gripping member 170 (not shown) which is attached to outer conductor 24 via attaching ring 174, screw 172, and screw 173 (not shown).

Outer conductor 24 of male section 202 and female section 204 need not be electrically isolated from the ambient environment as they are grounded with respect to the ambient environment.

As shown in FIG. 6 the back side of shuttle piston 120 engages Multilam or other suitable electrical contact band 156 to effect electrical interconnection. Termination projection 128 is fabricated from a strength dielectric material so that center conductor 122 of shuttle piston 120 is electrically isolated from inner conductor 22 when female section 204 is decoupled from male section 202 thereby allowing the connector to be operated with a voltage on female section 204.

Female section 204 includes ball bearings 220 disposed within opening 222 which engages surface 224 of male section 202 thereby facilitating the mating of connector 200.

A bulkhead 124, disposed within interconnection space 118 and abutting outer conductor 24, serves to retain shuttle piston 120 within interconnection space 118. Wiping O-ring seal 146 serves to prevent leakage of oil from interconnection space 118 rearward of O-ring wiping seal 146. Wiping seal 146 also wipes water from surface 56 of male core insert 40.

The termination of male section 202 with cable 12 (not shown) is identical to the termination of male section 10 of FIG. 1 with cable 12 except that outer conductor 24 of male section 202 is exposed to the ambient or seawater environment. Thus, boot 47 is fluid tightly connected to outer conductor 24 of male section 202 in FIG. 6 by screw clamp 226. Boot 47 encloses oil-filled space 45 which fluidically communicates with oil filled space 41 via orifice 23 thereby providing pressure compensation to space 41 as boot 47 is exposed to the ambient environment.

In connector 200 male outer conductor 24 extends outward from modification 14 to a point further from modification 14 than male inner conductor 22.

Male core dielectric insert 40 provides physical separation for support as well as electrical isolation between outer conductor 24 and inner conductor 22. Male core insert 40 is fabricated from a rigid dielectric material having mechanical strength. Male core insert 40 extends outward to a point adjacent termination end 38 of inner conductor 22. O-ring seals 44 and 46 prevent oil from space 41 from leaking out between male core insert 40 and outer conductor 24 and inner conductor 22. As in the embodiment of FIG. 1, surface 56 of male core insert 40 is wiped clean of water by wiping seal 146.

Connector 200 does not require a pressure compensating bladder such as pressure compensating bladder 52 of FIG. 1 because O-ring seals 60 have been eliminated in connector 200. Thus, in connector 200 there is no seawater trapped between two seals that could result in a hydraulic lock. Since outer conductor 24 is not electrically insulated from the ambient environment, only one seal is necessary.

Male outer conductor 24 mates with female outer conductor 24 with termination projection 228 of male outer conductor 24 engaging Multilam or other suitable contact band 230 disposed to ride within groove 232 of female outer conductor 24.

Ball bearings 234 are disposed within openings 236 of male outer conductor 24. Ball bearings 234 engage spring cover ring 206 to facilitate the mating of male section 202 and female section 204.

A slidable collar 62 is circumferentially disposed about male section 202 with ball bearings 238 sandwiched between male section 202 and collar 62 to facilitate the movement of collar 62 with respect to male section 202. Slidable collar 62 is biased in the forward position as shown in FIG. 6 by spring 66 which abuts stop 68 (rigidly affixed to male section 202) at one end and to stop surface 70 of slidable collar 62 at the other end.

In its forward position as shown in FIG. 6 detent 72 is biased via spring 240 to engage ridge 242 thereby preventing slidable collar 62 from moving backward in the direction of arrow 78 with respect to male section 202 until detent 72 is squeezed by manipulator or diver. Latch ridge 244 of collar 62 is disposed with respect to latch members 82 such that when collar 62 is moved in the direction of arrow 78 latch ridge 244 will engage latch member 82 causing latch member 82 to pivot about pin 86 thereby moving latch member 82 from a latched position to an unlatched position. The pin 86 is rigidly affixed to male section 202 thereby allowing latch member 82 to hold the full breaking strength of coaxial cable 12. Latch member 82 is spring biased by spring 84 in the latching position such that during mating, latch member 82 engages female shell ridge 246 automatically at latch member 82 passes over female shell ridge 246. It is noted that in the embodiment of FIG. 6 there are three latch members 82 but only one is illustrated in the cross sectional view.

Detent 72 is provided with a cover 248.

By eliminating the requirement for electrically insulating the outer conductor 24 from the ambient environment the size of connector 200 is reduced and the ease of mating and decoupling is increased. There is no possibility of a hydraulic lock forming between male section 202 and female section 204. In addition, the number of parts required to be fabricated from a dielectric material is reduced.

It is noted that circumferential ridges 246 and 242 as well as band contacts 156, 148 and 230 render male section 202 rotatable with respect to female section 204.

Obviously, numerous modifications and variations of the present invention are possible under the above teachings. It is therefore to be understood that within the scope of the appended claims the invention may be practiced otherwise than as specifically described herein.

What is claimed is:

1. An electrical coaxial wet connector, including a male and a female section for mating which produces a nearly perfect impedance match while maintaining a coaxial mode of signal propagation, comprising:

a. a female housing having a central opening therein and a longitudinal axis;

b. a female inner conductor disposed within said female housing along the longitudinal axis thereof;

c. a female outer conductor disposed within said female housing concentric with said inner conductor, said female outer conductor projecting outwards from said female inner conductor such that an interconnection space is formed within said female outer conductor, said female outer conductor having a termination end;

d. female dielectric means disposed between said inner and outer female conductors for providing electrical insulation therebetween;

e. a male housing having a central opening therein and a longitudinal axis, said male housing interfitting with said female housing with said female housing being partially surrounded by said male housing after mating;

f. a male inner conductor disposed within said male housing along the longitudinal axis thereof;

g. a male outer conductor disposed within said male housing concentric with said inner conductor, said male inner conductor projecting outwards from said male outer conductor, said male outer conductor adapted to receive said female outer conductor in electrical connection therewith;

h. male dielectric means disposed between said inner and outer male conductors for providing electrical insulation and a water-tight seal therebetween;

i. male facing means disposed concentric with said male outer conductor between said male outer conductor and said male housing, said male facing means forming a water-tight seal therebetween;

j. female facing lip means disposed concentric with said female outer conductor between said female outer conductor and said female housing, said female facing means forming a water-tight seal therebetween;

k. shuttle piston means disposed within said interconnection space for receiving said male inner conductor and electrically interconnecting said male and female inner conductors, said shuttle piston means being slidable within said interconnection space, said piston means having a front side for receiving said male inner conductor and a back side for engaging said female inner conductor;

l. seal means disposed within said interconnection space adjacent said female outer conductor termination end for providing a water-tight seal between said shuttle piston means and said female outer conductor before mating and between said male inner conductor and said female outer conductor after mating, thereby preventing water from entering said interconnection space rearward of said seal means;

m. spring bias means for maintaining said shuttle piston means in abutting relationship with said seal means before mating and for automatically returning said shuttle piston means to said abutting relationship during unmating.

2. The apparatus of claim 1 wherein said female facing lip means is configured to receive said male facing means in abutting relationship thereto with a water-tight seal being formed therebetween during mating.

3. The apparatus of claim 1 wherein said shuttle piston means includes:

a. a center conductor having electrical contacts on either end, said electrical contacts configured to receive said male inner conductor and said female inner conductor; and b. electrical insulating means circumferentially disposed about said center conductor.

4. The apparatus of claim 3 wherein said electrical insulating means contains at least one opening therethrough for the passage of dielectric fluid.

5. The apparatus of claim 3 wherein said electrical insulating means is fabricated from a rigid material and abuts said female outer conductor.

6. The apparatus of claim 1 wherein said female inner conductor includes a rigid dielectric projection member rigidly attached thereto, said projection member is disposed such that before mating said shuttle piston back side is electrically decoupled from said female inner conductor.

7. The apparatus of claim 1 wherein said spring bias means is coupled between said shuttle piston means and said rigid dielectric projection member.

8. The apparatus of claim 1 wherein said spring is coupled between said shuttle piston means and said female outer conductor.

9. The apparatus of claim 1 wherein said male dielectric means includes a rigid core dielectric means circumferentially disposed about said male inner conductor between said termination end and said male outer conductor, said core dielectric means configured to engage said seal means providing a watertight seal between said male inner conductor and said female outer conductor after mating.

10. The apparatus of claim 1 further including pressure compensation means fluidically communicating with said interconnection space adjacent the front side of said shuttle piston means for removing fluid trapped within said interconnection space during mating and for returning said fluid to said interconnection space during decoupling whereby hydraulic locks are prevented from forming during mating and decoupling.

11. The apparatus of claim 10 wherein said pressure compensation means includes at least one pressure compensating bladder having a portion thereof exposed to the ambient environment and means for fluidically coupling said pressure compensating bladder with said interconnection space adjacent the front side of said shuttle piston means.

12. The apparatus of claim 1 wherein said interconnection space rearward of said seal means is filled with a dielectric fluid.

13. The apparatus of claim 1 wherein said front side and said back side of said shuttle piston means includes electrical contact means rotatable therewith whereby relative rotation of said male and female sections may occur without degradation of the electrical connection therebetween.

14. The apparatus of claim 13 wherein said contact means includes annular multilam louvered contact members.

15. The apparatus of claim 1 further including means adjacent said male housing for transmitting a mechanical load from said male housing to said female housing.

16. The apparatus of claim 15 wherein said load transmitting means includes latch means adjacent said male housing for interlocking with said female housing after mating.

17. The apparatus of claim 16 wherein said latch means includes:

a. a plurality of latch members operable to move from an unlatched position to a latching position;

b. bias means adjacent each said latch member for maintaining said latch member in latching position;

c. means for moving said latch member from said latching position to said unlatched position when actuated.

18. The apparatus of claim 17 wherein said latch member moving means includes a collar slidably disposed adjacent said male housing and operable to engage said latch members such that said latch members are moved from said unlatched position to said latched position or vice versa in response to the movement of said collar.

19. The apparatus of claim 18 wherein said collar further includes a detent operable to engage a lip integral with said male housing.

20. The apparatus of claim 18 wherein said collar further includes bias means for maintaining said slidable collar in a forward position such that said latch members are disposed in said latching position.

21. The apparatus of claim 20 wherein said collar bias means includes a spring connected between said slidable collar and said male housing.

22. The apparatus of claim 17 wherein said latch member bias means includes a spring.

23. The apparatus of claim 18 further including means disposed between said collar and said male housing for facilitating the sliding of said collar with respect to said male housing.

24. The apparatus of claim 23 wherein said sliding facilitating means includes a plurality of ball bearings.

25. The apparatus of claim 17 further including a latch lip integral with said female housing and disposed for engagement with said latch members when in said latching position.

26. The apparatus of claim 1 wherein said male housing includes a flared section for facilitating mating of said male and female sections.

27. The apparatus of claim 1 wherein said seal means further includes a bulkhead for retaining said shuttle piston means within said interconnection space.

28. The apparatus of claim 27 wherein said seal means further includes an O-ring seal disposed within a groove in said bulkhead.

29. An electrical coaxial wet connector, including a male and a female section for mating which produces a nearly perfect impedance match while maintaining a coaxial mode of signal propagation, comprising:

a. a female section having a central opening therein and a longitudinal axis;

b. a female inner conductor disposed within said female section along the longitudinal axis thereof;

c. a female outer conductor concentric with said inner conductor, said female outer conductor projecting outwards from said female inner conductor such that an interconnection space is formed within said female outer conductor, said female outer conductor having a termination end;

d. female dielectric means disposed between said inner and outer female conductors for providing electrical insulation therebetween;

e. a male section having a central opening therein and a longitudinal axis, said male section interfitting with said female section with said female outer conductor being partially surrounded by said male outer conductor after mating;

f. a male inner conductor disposed within said male section along the longitudinal axis thereof;

g. a male outer conductor disposed within said male section concentric with said inner conductor, said male outer conductor projecting outwards from said male inner conductor, said male outer conductor adapted to receive said female outer conductor in electrical connection therewith;

h. male dielectric means disposed between said inner and outer male conductors for providing electrical insulation and a water-tight seal therebetween;

i. shuttle piston means disposed within said interconnection space for receiving said male inner conductor and electrically interconnecting said male and female inner conductors, said shuttle piston means being slidable within said interconnection space, said piston means having a front side for receiving said male inner conductor and a back side for engaging said female inner conductor;

j. seal means disposed within said interconnection space adjacent said female outer conductor termination end for providing a water-tight seal between said shuttle piston means and said female outer conductor before mating and between said male inner conductor and said female outer conductor after mating, thereby preventing water from entering said interconnection space rearward of said seal means; and k. spring bias means for maintaining said shuttle piston means in abutting relationship with said seal means before mating and for automatically returning said shuttle piston means to said abutting relationship during unmating.

30. The apparatus of claim 29 wherein said shuttle piston means includes:

a. a center conductor having electrical contacts on either end, said electrical contacts configured to receive said male inner conductor and said female inner conductor; and b. electrical insulating means circumferentially disposed about said center conductor.

31. The apparatus of claim 30 wherein said electrical insulating means contains at least one opening therethrough for the passage of dielectric fluid.

32. The apparatus of claim 30 wherein said electrical insulating means is fabricated from a rigid material and abuts said female outer conductor.

33. The apparatus of claim 29 wherein said female inner conductor includes a rigid dielectric projection member rigidly attached thereto, said projection member is disposed such that before mating said shuttle piston back side is electrically decoupled from said female inner conductor.

34. The apparatus of claim 29 wherein said bias means includes a spring coupled between said shuttle piston means and said female outer conductor.

35. The apparatus of claim 29 wherein said male dielectric means includes a rigid core dielectric means circumferentially disposed about said male inner conductor between said termination end and said male outer conductor, said core dielectric means configured to engage said seal means providing a water-tight seal between said male inner conductor and said female outer conductor after mating.

36. The apparatus of claim 29 wherein said interconnection space rearward of said seal means is filled with a dielectric fluid.

37. The apparatus of claim 29 wherein said front side and said back side of said shuttle piston means includes electrical contact means rotatable therewith whereby relative rotation of said male and female sections may occur without degradation of the electrical connection therebetween.

38. The apparatus of claim 37 wherein said contact means includes annular Multilam louvered contact members.

39. The apparatus of claim 29 further including means adjacent said male section for transmitting a mechanical load from said male outer conductor to said female outer conductor.

40. The apparatus of claim 39 wherein said load transmitting means includes latch means adjacent said male section for interlocking with said female section after mating.

41. The apparatus of claim 40 wherein said latch means includes:

a. a plurality of latch members operable to move from an unlatched position to a latching position;

b. bias means adjacent each said latch member for maintaining said latch member in latching position;

c. means for moving said latch member from said latching position to said unlatched position when actuated.

42. The apparatus of claim 41 wherein said latch member moving means includes a collar slidably disposed adjacent said male section and operable to engage said latch members such that said latch members are moved from said unlatched position to said latched position or vice versa in response to the movement of said collar.

43. The apparatus of claim 42 wherein said collar further includes a detent operable to engage a lip integral with said male outer conductor.

44. The apparatus of claim 42 wherein said collar further includes bias means for maintaining said slidable collar in a forward position such that said latch members are disposed in said latching position.

45. The apparatus of claim 44 wherein said collar bias means includes a spring connected between said slidable collar and said male outer conductor.

46. The apparatus of claim 41 wherein said latch member bias means includes a spring.

47. The apparatus of claim 41 further including means disposed between said collar and said male section for facilitating the sliding of said collar with respect to said male section.

48. The apparatus of claim 47 wherein said sliding facilitating means includes a plurality of ball bearings.

49. The apparatus of claim 41 further including a latch lip integral with said female outer conductor and disposed for engagement with said latch members when in said latching position.

50. The apparatus of claim 29 wherein said male housing includes a flared section for facilitating mating of said male and female sections.

51. The apparatus of claim 29 wherein said seal means further includes a bulkhead for retaining said shuttle piston means within said interconnection space.

52. The apparatus of claim 51 wherein said seal means further includes an O-ring seal disposed within a groove in said bulkhead.

53. The apparatus of claim 29 wherein said male and female outer conductors are exposed to the ambient environment.

54. The apparatus of claim 33 wherein said spring bias means includes a spring coupled between said shuttle piston means and said rigid dielectric projection member.

55. An electrical coaxial wet connector, including a male and a female section for mating which produces a nearly perfect impedance match while maintaining a coaxial mode of signal propagation, comprising:

a. a female housing having a central opening therein and a longitudinal axis;

b. a female inner conductor disposed within said female housing along the longitudinal axis thereof;

c. a female outer conductor disposed within said female housing concentric with said inner conductor, said female outer conductor projecting outwards from said female inner conductor such that an interconnection space is formed within said female outer conductor, said female outer conductor having a termination end;

d. female dielectric means disposed between said inner and outer female conductors for providing electrical insulation therebetween;

e. a male housing having a central opening therein and a longitudinal axis, said male housing interfitting with said female housing with said female housing being partially surrounded by said male housing after mating;

f. a male inner conductor disposed within said male housing along the longitudinal axis thereof;

g. a male outer conductor disposed within said male housing concentric with said inner conductor, said male inner conductor projecting outwards from said male outer conductor, said male outer conductor adapted to receive said female outer conductor in electrical connection therewith;

h. male dielectric means disposed between said inner and outer male conductors for providing electrical insulation and a water-tight seal therebetween;

i. male facing means disposed concentric with said male outer conductor between said male outer conductor and said male housing, said male facing means forming a water-tight seal therebetween;

j. female facing lip means disposed concentric with said female outer conductor between said female outer conductor and said female housing, said female facing means forming a water-tight seal therebetween;

k. shuttle piston means disposed within said interconnection space for receiving said male inner conductor and electrically interconnecting said male and female inner conductors, said shuttle piston means being slidable within said interconnection space, said piston means having a front side for receiving said male inner conductor and a back side for engaging said female inner conductor;

l. seal means disposed within said interconnection space adjacent said female outer conductor termination end for providing a water-tight seal between said shuttle piston means and said female outer conductor before mating and between said male inner conductor and said female outer conductor after mating, thereby preventing water from entering said interconnection space rearward of said seal means;

m. bias means for biasing said shuttle piston means in abutting relationship with said seal means before mating; and n. pressure compensation means fluidically communication with said interconnection space adjacent the front side of said shuttle piston means for removing fluid trapped within said interconnection space during mating and for returning said fluid to said interconnection space during decoupling whereby hydraulic locks are prevented from forming during mating and decoupling.

56. The apparatus of claim 55 wherein said pressure compensation means includes at least one pressure compensating bladder having a portion thereof exposed to the ambient environment and means for fluidically coupling said pressure compensating bladder with said interconnection space adjacent the front side of said shuttle piston means.

* * * * *